US005884339A

United States Patent [19]

Fukasawa

[11] Patent Number: 5,884,339

[45] Date of Patent: Mar. 23, 1999

[54] SWIMMING GOGGLES

[75] Inventor: Shunji Fukasawa, Tokyo, Japan

[73] Assignee: Tabata Co., Ltd., Tokyo, Japan

[21] Appl. No.: 132,666

[22] Filed: Aug. 12, 1998

[30] Foreign Application Priority Data

Aug. 13, 1997 [JP] Japan ..... 9-218753

[51] Int. Cl.[6] ..... A61F 9/02

[52] U.S. Cl. ..... 2/446; 2/440

[58] Field of Search ..... 2/426, 431, 438, 2/440, 441, 442, 443, 445, 446, 454

[56] References Cited

U.S. PATENT DOCUMENTS

| | | | |
|---|---|---|---|
| 4,348,775 | 9/1982 | Haslbeck | 2/446 |
| 5,046,199 | 9/1991 | Hall | 2/446 |
| 5,404,385 | 4/1995 | Ben-Haim | 2/426 |
| 5,546,611 | 8/1996 | Lathrop | 2/426 |
| 5,711,036 | 1/1998 | Kita | 2/426 |

FOREIGN PATENT DOCUMENTS

| | | | |
|---|---|---|---|
| 1118953 | 3/1982 | Canada | 2/426 |
| 7-28577 | 5/1995 | Japan . | |
| 2052245 | 1/1981 | United Kingdom | 2/440 |

*Primary Examiner*—Michael A. Neas
*Assistant Examiner*—Kate Moran
*Attorney, Agent, or Firm*—Lowe Hauptman Gopstein Gilman & Berner

[57] ABSTRACT

The invention aims to provide swimming goggles making it possible to adjust a distance finely between inner ends of two lens frame members.

Of swimming goggles, inner ends 3 of two lens frame members 2 each surrounding a lens 2A are connected to each other through a nose belt 4. Each of the inner ends 3 and each end portion of the nose belt 4 are respectively provided with first and second interlocking configurations adapted to be releasably interlocked with each other. One of these first and second interlocking configurations includes at least one ring-shaped member 17 and a shaft 13 on which the ring-shaped member 17 is movably put while the other of these first and second interlocking configurations is releasably interlocked with the shaft 13 at a position given by selectively positioning the ring-shaped member 17.

4 Claims, 3 Drawing Sheets

SWIMMING GOGGLES

BACKGROUND OF THE INVENTION

This invention relates to swimming goggles.

Japanese Utility Model Application Laid-Open No. 1995-28577 discloses swimming goggles in which a distance between inner ends of two lens frame members is adjustable. According to the disclosure, the lens frame members are connected to each other through a nose belt and the inner ends of the lens frame members are formed with detents which can be selectively and releasably interlocked with any one of a plurality of projections arranged on the nose belt longitudinally thereof. The distance between the inner ends of the lens frame members can be adjusted by selecting the projections to be interlocked with the detents.

In the above-mentioned swimming goggles of well known art, the nose belt and the projections fixed thereon are integrally molded from soft elastic material. These projections are large enough to prevent themselves from disengaging from the detents. However, a fine adjustment of the distance is difficult in such swimming goggles, since the extent of the adjustment is limited by a size and a fixed position of each projection.

SUMMARY OF THE INVENTION

In view of the problem as has been described above, it is a principal object of the invention to provide swimming goggles in which a distance between the inner ends of the two lens frame members to be finely adjustable.

The object set forth above is achieved, according to the invention, by swimming goggles comprising a pair of lens frame members each holding a lens and a nose belt releasably interlocked with inner ends of the lens frame members and thereby enabling a distance between the inner ends to be adjusted, the swimming goggles being characterized by that: each of the lens frame members is provided at its inner end with a first interlocking configuration while the nose belt is provided at each of its longitudinally opposite end portions with a second interlocking configuration serving as a counterpart adapted to be releasably interlocked with the first interlocking configuration; and one of the first and second interlocking configurations includes at least one ring-shaped member and a shaft on which the ring-shaped member is put, the ring-shaped member being movable along the shaft in a direction connecting the inner ends of the frame members respectively but unable to fall off from the shaft while the other of the first and second interlocking configurations is releasably interlocked with the shaft so that the ring-shaped Member may be moved in the direction to select a position at which the other interlocking configuration is releasably interlocked with the shaft and thereby to adjust the distance between the inner ends of the lens frame members.

According to another embodiment of the invention, a plurality of the ring-shaped members are put on each of the shafts in the proximity of its longitudinally opposite ends and the other interlocking configuration is releasably interlocked with the shaft at a position defined between the ring-shaped members which are selectively spaced from each other.

According to still another embodiment, the nose belt includes the ring-shaped members and the shaft, or the lens frame member includes the ring-shaped members and the shaft.

DESCRIPTION OF THE PREFERRED EMBODIMENTS

Details of swimming goggles according to the invention will be more fully understood from the description given hereunder in reference with the accompanying drawings.

Figure 1:
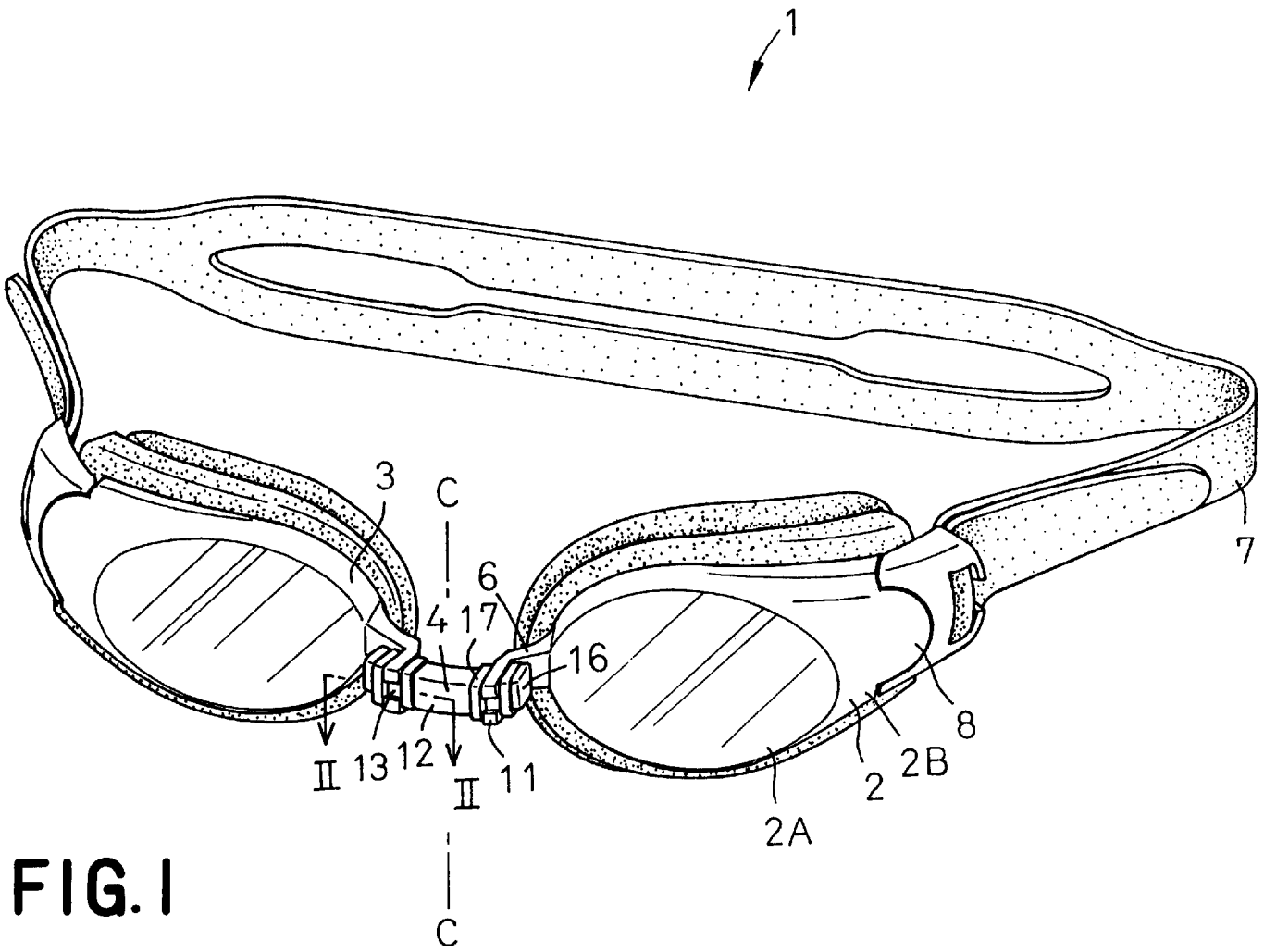
FIG. 1 is a perspective view showing swimming goggles according to the invention.

Swimming goggles 1 shown by FIG. 1 in a perspective view comprise a pair of lens frame members 2 each formed integrally with a lens 2A, a nose belt 4 connecting an inner end 3 of the one lens frame member 2 to an inner end 3 of the other lens frame member 2 and a head band 7 extending between outer ends 8, 8 of the lens frame members 2, 2. The lens frame members 2, 2 have arms 6 extending in a direction convenient for interconnection of the inner ends 3, 3 of the lens frame members 2, 2 and these arms 6, 6 are formed at their distal ends with belt locks 11, 11 opening forward with respect to the swimming goggles 1.

The nose belt 4 has its longitudinally opposite end portions 13, 13 extending from its middle portion 12 toward the lens frame members 2, 2 respectively and detachably locked by the belt locks 11, 11 respectively. Each of these end portions 13, 13 is formed at its distal end with a flange 16 and a pair of spacer rings 17, 17 are interposed between the flange 16 and the middle portion 12 so that the spacer rings 17, 17 may be slidably moved along the end portion 13. FIG. 1 shows the nose belt 4 as being locked by the belt lock 11 between the pair of spacer rings 17, 17 spaced from each other.

Figure 3:
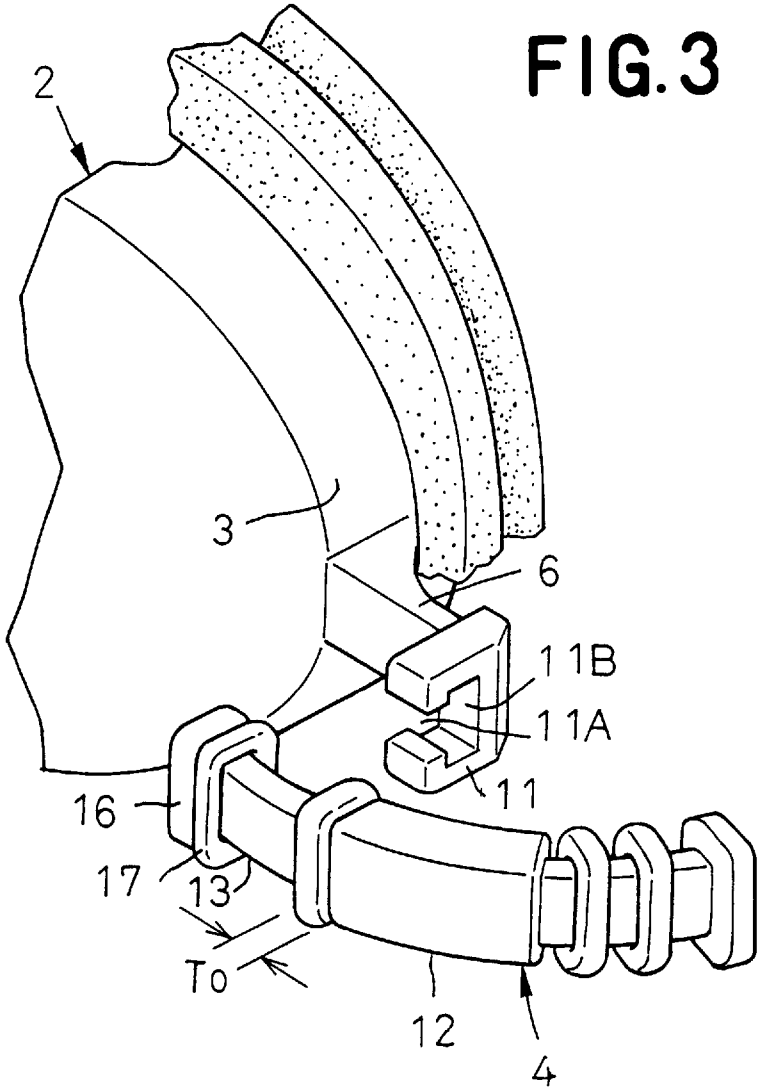
FIG. 3 is a perspective view showing an inner end portion and a nose belt of the swimming goggles.
Figure 2:
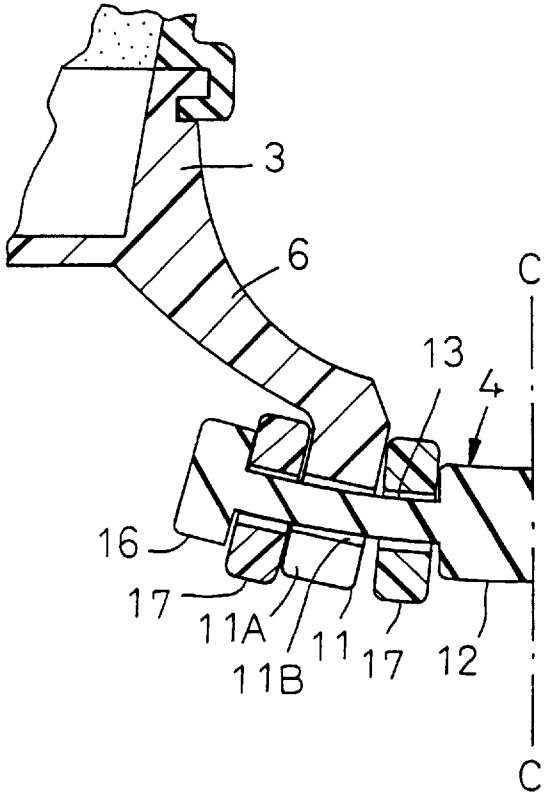
FIG. 2 is a sectional view taken along a line II—II in FIG. 1.

FIG. 2 is a sectional view taken along a line II—II in FIG. 1, and FIG. 3 is a perspective view showing the inner end 3 of the lens frame member 2 and the nose belt 4 detached from the inner end 3. The belt lock 11 provided on the inner end 3 of the lens frame member 2 presents a C-shape or an inverted C-shape as viewed from a center line C—C of the swimming goggles. The belt lock 11 has a front open mouth 11A for insertion of the nose belt 4 and a band receiving recess 11B defined behind the open mouth 11A. A vertical dimension of the open mouth 11A is smaller than a vertical dimension of the belt end portion 13. The receiving recess 11B has a height and a depth substantially equal to or larger than the corresponding dimensions of the belt end portion 13.

The nose belt 4 comprises a middle portion 12, the belt end portions 13, 13 laterally extending from longitudinally opposite ends of the middle portion 12 and having their diameters smaller than a diameter of the middle portion 12, the pair of flanges 16, 16 formed at the distal ends of the respective end portions 13, 13 and having diameters larger than the diameters of the end portions 13, 13 and sets of spacer rings 17, 17 which are movable on, preferably slidably movable along the end portions 13, 13 respectively between the middle portion 12 and the flanges 16, 16. The flanges 16, 16 prevents the rings 17, 17 from falling off from the nose belt 4.

FIGS. 1 and 2 show a situation in which one of the rings 17 is put to the middle portion 12 and the other is put to the flange 16 with the belt lock 11 being interposed between these rings 17, 17 spaced from each other. Alternatively, the both rings 17, 17 may be put to the middle portion 12 and the belt lock 11 may be interposed between the flange 16 and the ring 17 to enlarge a distance between the inner ends 3, 3 of the lens frame members 2, 2. Reversely, these both rings 17, 17 may be put to the flange 16 and the belt lock 11 may be interposed between the middle portion 12 and the ring 17 to reduce the distance between the inner ends 3, 3 of the lens frame members 2, 2.

With the swimming goggles 1 constructed as has been described above, the lens frame members 2, 2 are molded from hard plastic -material and the nose belt 4 is preferably molded from elastic material. The end portion 13 of the nose belt 4 has a diameter and a cross-section selected so that the end portion 13 can be inserted through the open mouth 11A of the belt lock 11 preferably under an elastic deformation of the end portion 13 into the receiving recess 11B and can be drawn out from the receiving recess 11B through the open mouth 11A.

Regarding the nose belt 4, it should be understood that the number of the spacer rings 17, 17, . . . to be placed on each of the belt end portions 13, 13 is not limited to one pair as in the illustrated embodiment but may be one or three or more. In any case, the distance between the inner ends 3, 3 of the lens frame members 2, 2 can be adjusted by selectively positioning the rings 17, 17. To achieve fine adjustment of the distance, a thickness $T_0$ of each ring 17 may be selected as small as possible since the distance is depend on the thickness $T_0$ of each ring 17.

Figure 4:
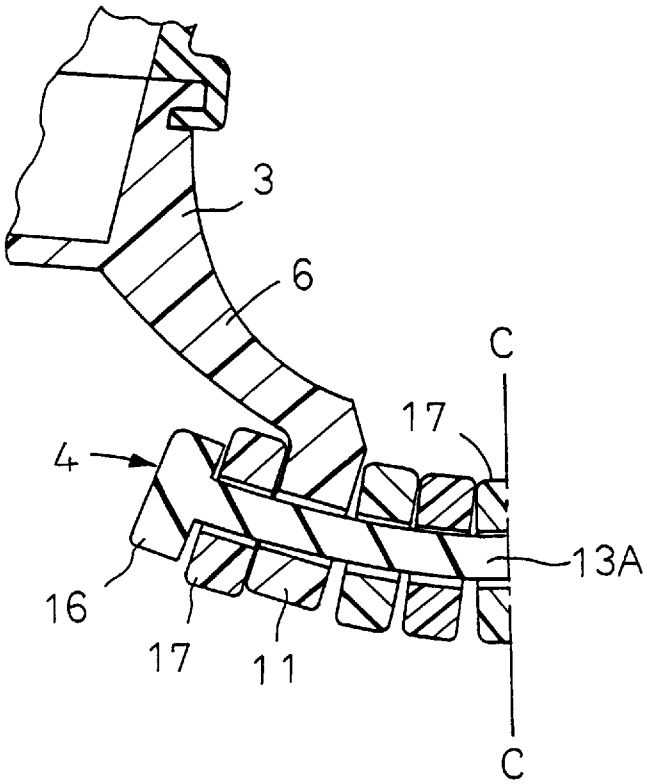
FIG. 4 is a view similar to FIG. 2 showing another embodiment of the invention.

FIG. 4 is a view similar to FIG. 2 showing an alternative embodiment of the invention. The nose belt 4 in this swimming goggles 1 differs from the nose belt 4 previously described in reference with FIG. 2 in that the diameter-enlarged middle portion 12 is eliminated and replaced by a band 13A comprising the right and left belt end portions 13, 13 extending toward the center line C—C so as to form a continuous and integral belt 13A. There are provided on this belt 13A two or more, preferably four or more, and more preferably five or more spacer rings 17, 17, . . . adapted to be movable along the belt 13A. The belt 13A can be inserted into the belt locks 11, 11 between pairs of adjacent rings 17, 17 or between the flange 16 and the ring 17 adjacent to the flange 16.

Figure 5:
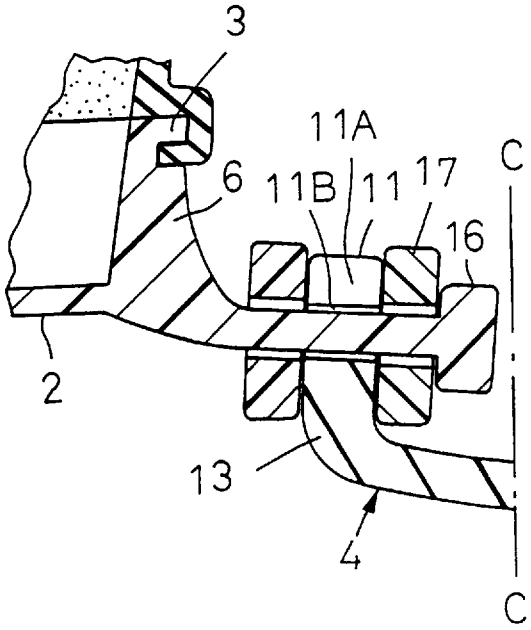
FIG. 5 is a view similar to FIG. 2 showing still another embodiment of the invention.

FIG. 5 also is a view similar to FIG. 2 showing another alternative embodiment of the invention. In the swimming goggles 1 according to this embodiment, the arms 6, 6 extend from the inner ends 3, 3 of the lens frame members 2, 2 close to the center line C—C and their distal ends have the flanges 16, 16, respectively. Each of these arms 6, 6 carries thereon a pair of spacer rings 17, 17 which are movable along this arm 6 axially thereof. The nose belt 4 is formed at its longitudinally opposite end portions 13, 13 with arm locks 11, 11 adapted to be releasably interlocked with the arms 6, 6. Each of these arm locks 11, 11 has the open mouth 11A and the receiving recess 11B like those of the belt locks 11, 11 shown in FIGS. 1 and 2. In this case also, the inner ends 3, 3 are molded from hard plastic material and the nose belt 4 is molded from elastic material.

According to these embodiments, a lens 2A, a frame 2B surrounding the lens 2A and the belt lock 11 adapted to be releasably interlocked with the nose belt 4 are integrally molded to obtain the lens frame member 2. Alternatively, the lens and the frame may be separately provided and the lens may be formed with the belt lock 11 adapted to be releasably interlocked with the nose belt 4 or the separately provided frame may be formed with the belt lock 11 in order to obtain the lens frame member 2.

The swimming goggles according to the invention makes it possible to adjust the distance between the inner ends of the lens frame members by selectively positioning the spacers. With a consequence, a fine adjustment of the distance can be achieved by dimensioning a thickness of the individual spacer to be as small as possible.

What is claimed is:

1. Swimming goggles comprising a pair of lens frame members each holding a lens and a nose belt releasably interlocked with inner ends of the lens frame members and thereby making it possible to adjust a distance between the inner ends the swimming goggles being characterized by that:

each of the lens frame members is provided at its inner end with a first interlocking configuration while the nose belt is provided at each of its longitudinally opposite end portions with a second interlocking configuration serving as a counterpart adapted to be releasably interlocked with the first interlocking configuration; and one of the first and second interlocking configurations includes at least one ring-shaped member and a shaft on which the ring-shaped member is put, the ring-shaped member being movable along the shaft in a direction connecting the inner ends of the respective lens frame members but unable to fall off from the shaft while the other of the first and second interlocking configurations is releasably interlocked with the shaft so that the ring-shaped member may be moved in the direction to select a position at which the other interlocking configuration is releasably interlocked with the shaft and thereby to adjust the distance between the inner ends of the lens frame members.

2. The swimming goggles according to claim 1, wherein a plurality of the ring-shaped members are put on each of the shafts in the proximity of its longitudinally opposite ends and the other interlocking configuration is releasably interlocked with the shaft at a position defined between the ring-shaped members which are selectively spaced from each other.

3. The swimming goggles according to claim 1, wherein the nose belt includes the ring-shaped members and the shaft.

4. The swimming goggles according to claim 1, wherein the lens frame member includes the ring-shaped members and the shaft.

* * * * *